US011199010B2

(12) United States Patent
Dürnberger

(10) Patent No.: US 11,199,010 B2
(45) Date of Patent: Dec. 14, 2021

(54) FLOORING SYSTEM WITH ENHANCED FLEXIBILITY

(71) Applicant: Xylo Technologies AG, Niederteufen (CH)

(72) Inventor: Gerhard Dürnberger, Strasswalchen (AT)

(73) Assignee: Xylo Technologies AG, Niederteufen (CH)

( * ) Notice: Subject to any disclaimer, the term of this patent is extended or adjusted under 35 U.S.C. 154(b) by 0 days.

(21) Appl. No.: 16/757,699

(22) PCT Filed: Oct. 25, 2017

(86) PCT No.: PCT/EP2017/077368

§ 371 (c)(1),
(2) Date: Apr. 20, 2020

(87) PCT Pub. No.: WO2019/081016

PCT Pub. Date: May 2, 2019

(65) Prior Publication Data

US 2020/0270874 A1 Aug. 27, 2020

(51) Int. Cl.

| | |
|---|---|
| ***E04C 3/00*** | (2006.01) |
| ***E04F 15/02*** | (2006.01) |
| ***E04F 15/10*** | (2006.01) |

(52) U.S. Cl.

CPC .. *E04F 15/02033* (2013.01); *E04F 15/02038* (2013.01); *E04F 15/102* (2013.01);
(Continued)

(58) Field of Classification Search

CPC ..... E04F 15/02033; E04F 15/02038; E04F 15/107; E04F 15/102; E04F 2201/042;
(Continued)

(56) References Cited

U.S. PATENT DOCUMENTS

| | | | |
|---|---|---|---|
| 8,720,149 | B2 | 5/2014 | Bossuyt |
| 10,024,066 | B2 | 7/2018 | Dossche et al. |

(Continued)

FOREIGN PATENT DOCUMENTS

| | | | |
|---|---|---|---|
| CN | 103206063 | A | 7/2013 |
| CN | 205990727 | U | 3/2017 |

(Continued)

OTHER PUBLICATIONS

International Search Report and Written Opinion, dated Jul. 18, 2018, issued in International Application No. PCT/EP2017/077368, pp. 1-11, European Patent Office, Rijswijk, Netherlands.

(Continued)

*Primary Examiner* — Chi Q Nguyen
(74) *Attorney, Agent, or Firm* — Crowell & Moring LLP

(57) ABSTRACT

A flooring system is provided comprising a plurality of (identical) floor panels, which are mechanically connectable to each other along at least one pair of adjacent first and second opposite joint edges. The panels comprise locking elements for connecting said panels in both horizontal and vertical direction. In order to consider the often occurring situation that in panels—especially when stored under changing external conditions, especially changing humidity—might warp, the (vertical) locking element in the panels is constructed with a (slight) play, so that in the event that two panels have slightly different warp nevertheless can easily and reliably be mechanically connected with each other omitting the need to exert an excess of force to fit the panels.

17 Claims, 5 Drawing Sheets

(52) U.S. Cl.
CPC .... *E04F 15/107* (2013.01); *E04F 2201/0107* (2013.01); *E04F 2201/0138* (2013.01); *E04F 2201/03* (2013.01); *E04F 2201/043* (2013.01)

(58) Field of Classification Search
CPC ..... E04F 2201/0107; E04F 2201/03; E04F 2201/0552; E04F 2201/023; E04F 2201/0535; E04F 2201/0146; E04F 2201/043; E04F 2201/0547; E04F 2201/0153; E04F 2201/0138
USPC .. 52/592.1, 592.3, 292.2, 578, 588.1, 309.1, 52/309.3, 592.2
See application file for complete search history.

(56) References Cited

U.S. PATENT DOCUMENTS

| | | | | |
|---|---|---|---|---|
| 10,161,139 | B2 | 12/2018 | Pervan | |
| 10,316,526 | B2 * | 6/2019 | Kell | E04F 13/0889 |
| 2002/0007609 | A1 * | 1/2002 | Pervan | E04F 15/04 52/590.2 |
| 2004/0128934 | A1 * | 7/2004 | Hecht | E04F 15/02 52/578 |
| 2005/0050827 | A1 * | 3/2005 | Schitter | B44C 5/043 52/578 |
| 2006/0156670 | A1 * | 7/2006 | Knauseder | E04F 15/02 52/578 |
| 2009/0249733 | A1 * | 10/2009 | Moebus | E04F 15/04 52/588.1 |
| 2010/0018147 | A1 * | 1/2010 | Du | E04F 15/02038 52/506.05 |
| 2012/0317911 | A1 * | 12/2012 | Huang | E04F 15/02038 52/309.1 |
| 2013/0036695 | A1 * | 2/2013 | Durnberger | E04F 15/02038 52/309.3 |
| 2013/0097959 | A1 | 4/2013 | Michel | |
| 2013/0192158 | A1 | 8/2013 | Cappelle et al. | |
| 2015/0284964 | A1 * | 10/2015 | Yau | E04F 15/042 52/588.1 |
| 2016/0097959 | A1 | 4/2016 | Bruizeman et al. | |
| 2017/0241136 | A1 * | 8/2017 | Kell | E04F 15/02033 |
| 2017/0292276 | A1 * | 10/2017 | Cappelle | E04F 15/02038 |
| 2018/0119429 | A1 * | 5/2018 | Schulte | E04F 15/02038 |

FOREIGN PATENT DOCUMENTS

| | | | |
|---|---|---|---|
| CN | 107060258 | A | 8/2017 |
| CN | 107109850 | A | 8/2017 |
| RU | 2414570 | C2 | 8/2006 |
| WO | WO 2007/081256 | A1 | 7/2007 |
| WO | WO 2014/007738 | A1 | 1/2014 |
| WO | WO 2016/029255 | A1 | 3/2016 |

OTHER PUBLICATIONS

Russian Search Report with English translation, issued in Russian application 2020114247/03, dated Nov. 24, 2020, pp. 1-4, Federal Service for Intellectual Property, Moscow, Russia.
Russian Office Action with English translation, dated Nov. 27, 2020, pp. 1-7, Russian Patent Application No. 2020114247/03(023843), Patent Office of The Russian Federation, Moscow, Russia.
Chinese Office Action with English translation, dated Dec. 4, 2020, pp. 1-14, Chinese Patent Application No. 201780096265.8, China National Intellectual Property Administration, Beijing, China.
Ukrainian Office Action with English translation for Ukrainian Patent application No. a202002348, dated Jun. 1, 2021, National Intellectual Property Authority State Enterprise, Ukrainian Institute for Intellectual Property, 1 Glazunova St., Kyiv 42, 01601, Ukraine.

* cited by examiner

FLOORING SYSTEM WITH ENHANCED FLEXIBILITY

CROSS-REFERENCE TO RELATED APPLICATIONS

This application is a 371 nationalization of international patent application PCT/EP2017/077368 filed Oct. 25, 2017, the entire contents of which is hereby incorporated by reference.

DETAILED DESCRIPTION

Figure 1:
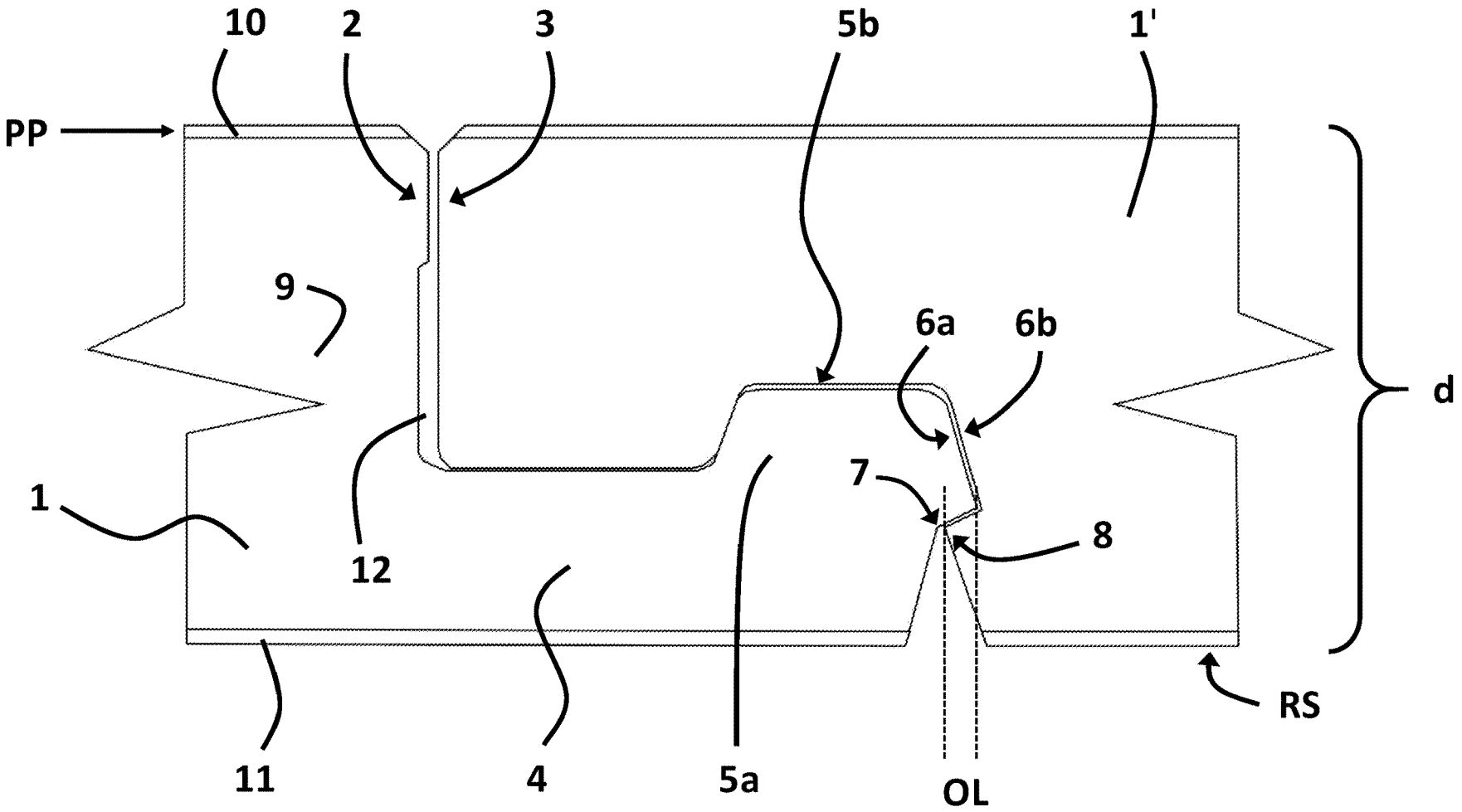
FIG. 1 shows a view on a sectional plane, which is perpendicular to the joint edges of a flooring system known from the state of the art without play of protrusion and a recess.

The present invention is directed to a flooring system comprising a plurality of (identical) floor panels which are mechanically connectable to each other along at least one pair of adjacent first and second opposite joint edges. The panels comprise locking elements for connecting said panels in both horizontal and vertical direction. In order to consider the often occurring situation that in panels—especially when stored under changing external conditions, especially changing humidity—might warp, the (vertical) locking element in the panels is constructed with a (slight) play, so that in the event that two panels have slightly different warp nevertheless can easily and reliably be mechanically connected with each other omitting the need to exert an excess of force to fit the panels.

Flooring systems which allow mechanical connecting of identical panels with each other have along been known. For example, WO 01/02669 A1 describes a fastening system for panels, especially for floor panels that are placed on a base and whose edges are provided with holding profiles. The holding profiles of a long edge and a holding profile of the opposite edge as well as the holding profiles on the other two short edges of a panel match one another in such a manner that further panels can be fastened to the free edges of one of the placed panels. The holding profiles of the long edge of the panels are configured as complementary positive fit profiles and the panels are interconnected by pivoting them to be joined. The complementary positive fit profile is provided with a recess opposite the edge of the panel. The other side facing away from the base is beveled so that there is room for the common joint.

BE 557844 describes inter-connectable panels with according male and female fitting members, which are designed to provide mechanical locking of interconnected panels. The fitting members abut against each other in the installed state.

EP 1 165 906 B1 describes a fastening system for panels, said panels having inter-locking profiles associated with one another, so that the panels are fastenable to one another by a turning joining action. One of the faces of the panels has a groove and the opposite face of this panel has a matching projection which, when installed are responsible for the fastening of the panels with each other.

AT 321529 describes a form fitting groove connection of panels which can be adjoined by joint-turning action.

All mechanical locking systems known from the prior art always are focusing on a complete form fit of the locking elements for providing the best possible fixing or locking of the panels once installed.

The drawback of these locking systems, however, is that they lack flexibility. Especially panels partly containing or being made of natural materials such as wood or wood fibers are subject to warpage, which e.g. occurs during storage of these panels, during which the panels are subject to varying external influences such as temperature, humidity and of aging of the materials of the panels. Also the locking members, being integral part of such panels are subject to such slight warpage. In the context of the present invention the term "warp" or "warpage" is synonymously understood to the term "flatness", especially "width flatness" as defined in EN 13329 (2016 July) ("Laminate floor coverings—Elements with a surface layer based on aminoplastic thermosetting resins—Specifications, requirements and test methods") and determined in the same way. Especially, when locking elements are made to completely form-fit with each other, a warp of the panels can make it difficult or even impossible to install the panels with each other. Normally extra physical effort or force has to be exerted when warped panels with different warpage are to be installed with each other. This extra effort can lead to a damage or even destruction of the locking members and/or the visible surface of the panels, thus making them unsuitable for installation.

Accordingly, the object of the present invention is to eliminate the above drawbacks in flooring panels, providing a new installation system which also makes it possible to easily but still reliably install also slightly warped panels.

A flooring system, comprising a plurality of floor panels which are mechanically connectable to each other along at least one pair of adjacent first and second opposite joint edges, said panels being provided with a locking strip provided at said first joint edge, said locking strip extending beyond the first joint edge and being provided with a locking element (5*a*) extending in direction of a principal plane of the panels, a locking groove at said second opposite joint edge for receiving said locking element and thus mechanically locking together said adjacent joint edges parallel to a principal plane, the locking groove being open towards a rear side of the panel, a) with an upper locking surface, and said locking groove comprises an internal edge with a protrusion with an upper locking surface, or b) said locking element comprises an external edge with a protrusion with an upper locking surface, and said locking groove comprises an internal edge with a recess with an upper locking surface, said protrusion engages said recess when two panels are mechanically connected to each other, so that in projection on the principal plane the upper locking surface of the recess and the upper locking surface of the protrusion overlap at least in parts, wherein at any given position of the overlap in any sectional plane of each panel, said sectional plane being perpendicular to the adjacent first and second opposite joint edges, the upper locking surface of the recess is distanced further from the rear side than the upper locking surface of the protrusion to form a gap.

The principle plane of the floor panel according to the present invention is the visible side of the floor panel when installed, where e.g. a decorative layer is present. Accordingly, the rear side of a floor panel is the invisible side of the floor panel, i.e. the side facing the floor on which the floor panel is installed. The rear side is opposite to the principal plane.

The sectional plane or the plurality of sectional planes virtually intersects the panel from the first to the second joint edge, which are arranged on opposite sides of the panel. The sectional planes are chosen to intersect the first and second joint edge at a right angle. The position of the locking surface of the recess with respect to the distance of upper locking surface of the protrusion from the rear side of each panel is determined in this or this plurality of sectional planes.

For determination or measurement of the respective distances of the upper locking surface of the recess and the upper locking surface of the protrusion with respect to the rear surface of the panel the principles of the "determination of thickness" as defined in EN 13329 (2016 July) ("Laminate floor coverings—Elements with a surface layer based on aminoplastic thermosetting resins—Specifications, requirements and test methods") are applied.

Preferably, the gap formed in between the upper locking surface of the recess and the upper locking surface of the protrusion is greater than or equal to the manufacturing tolerance of the profiles (i.e. the locking strip, locking element, locking groove, recess, upper locking surface of the recess, protrusion and upper locking surface of the protrusion) of the panels, which regularly is 0.05 mm.

Preferably, the floor panels have a rectangular or quadratic shape (with respect to a projection on the principle plane). However, also different shapes are possible such as hexagonal circumferences. Especially, preferred floor panels according to the present invention have a rectangular shape with two opposite long and two opposite short edges. According to an especially a preferred embodiment of the present invention, the above-mentioned adjacent joint edges represent the both short edges of an according rectangular floor panel.

The locking element, engaging with said locking groove in the installed state enables for a horizontal inter-connecting or fixing of installed floor panels of the flooring system. The protrusion and the recess being present on the locking element or the locking groove, respectively allow a vertical securing (i.e. in direction of the vertical plane) of installed floor panels.

According to the present invention, a slight play between the respective upper locking surfaces of the protrusion and the recess is present, which can be measured via the position of the respective surfaces of the recess or the protrusion, respectively in vertical direction, e.g. perpendicular from the rear side of each panel in direction to the principal plane of each panels at the same horizontal position which is the position where the protrusion engages the recess of two adjacent (identical) panels in the normal locked state. The gap is present in any virtual intersecting plane in the panel as defined above, thus eliminating the third dimension of the panel and any possibly existing warpage of the panel in the (not considered) third dimension. Thus a circumference of the panel in the defined plane which is perpendicular to the joint edges is defined.

When considering the additional dimension of the panels, the above-mentioned gap is present over the complete length of the joint edges, when the panels are completely unwarped or have the same degree of warpage along the first and second edges. If one panel has a different degree of warpage along the first and/or second joint edge, compared with a panel with which it is to be installed, however, a partial physical contact of the respective upper locking surfaces of the recess and the protrusion nevertheless is possible.

Due to the fact that the respective vertical locking surfaces are distanced from each other a slight play between the recess and protrusion is present, making it easier to install the panels, especially when the panels are warped with different degrees of warpage. This enhanced flexibility allows for an installation of floor panels, with degrees of warpage at first and second joined edges. For example, one panel can have a different degree of warpage with respect to another panel which is to be installed with the first panel. For example the warpage can have the shape of an irregular or regular curvature along the first and/or second joined edges. An enhanced and better installability also is given if one panel shows no warpage at all and the second panel, exhibiting certain amount of warpage, is to be installed with said unwarped panel. Of course also two unwarped panels can be installed with each other.

The slight play between recess and protrusion therefore contributes to the fact that recess and protrusion not necessarily are in physical contact with each other when two panels are installed. For example, if two completely unwarped panels (i.e. with no warpage along the first and second joined edge to be installed with respect to each other) are installed, a physical gap is present over the complete length of the first and second joined edges. However, if panels with different degree of warpage along the first and second joined edges are installed with each other, an actual physical contact between the recess and the first protrusion can be present, depending on the degree of deviation of the warpage in the panels installed with each other. In the first case, a slight loss in the physical strength of the vertical connection is accepted, since the play between recess and warpage considerably contributes to a better installability of the flooring panels, especially when warpage as described above occurs. In this case, the panels are installable with less force. Due to the fact, that somewhere along the first and second joined edges a physical contact of the protrusion and the recess occurs in this case—since the first and second joined edges are not completely even—no a loss in the quality of the vertical locking occurs in the second case.

According to a specific embodiment, said recess is defined by the upper locking surface falling off from the external edge in direction of the first joint edge and a second edge intersecting with the upper locking surface, wherein the upper locking surface and the second edge preferably form a obtuse angle at said recess, and/or said protrusion is defined by the upper locking surface protruding from the internal edge in direction of the first joint edge and a second edge falling off from the upper locking surface, wherein the upper locking surface (and the second edge preferably form an angle at said protrusion which is smaller than the obtuse angle defining said recess.

Alternatively, yet equally preferred, said recess is defined by the upper locking surface falling off from the internal edge in direction of the second joint edge and a second edge intersecting with the upper locking surface, wherein the upper locking surface and the second edge preferably form a obtuse angle at said recess, and/or said protrusion is defined by the upper locking surface protruding from the external edge in direction of the second joint edge and a second edge falling off from the upper locking surface, wherein the upper locking surface and the second edge preferably form an angle at said protrusion which is smaller than the obtuse angle defining said recess.

For example the upper locking surface of the recess, the upper locking surface of the protrusion, the second edge of the recess and/or the second edge of the protrusion are straight, wavy or curved, preferably straight.

The upper locking surface of the recess and the upper locking surface of the protrusion preferably at any given position of the overlap have a minimum distance (gap width) of 0.05 to 2.0 mm, preferably 0.1 to 1.0 mm, especially preferred 0.2 to 0.5 mm, e.g. 0.25 to 0.35 mm.

The minimum distance refers to the fact that the distance between the upper locking surface of the recess and the upper locking surface of the protrusion can be variable, especially if the edges do e.g. not run parallel.

In a preferred embodiment, in each panel the distance of the upper locking surface of the recess and the upper locking surface of the protrusion is constant at any given position of the overlap.

Especially preferred the upper locking surfaces are straight or planar and have a constant distance from each other over their entire overlap.

Furthermore it is preferred that the upper locking surface of the recess and the upper locking surface of the protrusion both are straight and have an angle of 10° to 50°, preferably 20° to 40°, especially preferred 27.5° to 32.5° with respect to the principal plane.

The above-defined obtuse angle is preferably is in between 100° and 170°, preferably 115 and 155°, especially preferred 130° and 140°.

According to further preferred embodiment, the upper locking surface and the second edge of the protrusion form an angle between 80° to 130°, preferably 90° to 120°, especially preferred 100° to 110°.

Furthermore, it is preferred that said panels are made of a core, a decorative layer and optionally a backing layer, wherein the locking strip and the locking groove are made in the core.

Exemplary materials of the core are wood or of wood based material such as MDF, HDF, OSB, chipboard; thermoplastic resins such as PVC; mineral-, glass- or rock wool, and/or cement.

The decorative layer can be made of a decorative paper with an optional abrasion-resistant topping and/or is printed to the core.

The backing layer preferably is made of paper (counter-draw paper), veneer, cork, rubber, thermoplastic resin and/or a foamed material.

It is preferred if the locking strip with the locking element is formed in one piece with the panels or provided as separate part which is fixed to the panels at the first joint edges.

Furthermore, the first and/or second joint edges can comprise at least one dust pocket which can be a recess in one or both joint edges.

Additionally, the panels according to the present invention can optionally be provided with additional locking elements guaranteeing a vertical locking of two panels with respect to each other. These additional locking elements preferably are provided in the first and second opposite joint edges.

According to specific embodiments, the panels are provided with a first groove formed in one piece with the panels at the first joint edge, said first groove being shaped to receive a groove part of a flexible tongue, said flexible tongue having a locking part which is formed in one piece with the groove part, said locking part extending beyond the first joint edge and a second groove formed in one piece with the panels at the second joint edge, said second groove being shaped to receive the locking part of the flexible tongue when the panels are mechanically locked, thereby forming a vertical mechanical connection between the panels, or a first groove formed in one piece with the panels at the second joint edge, said first groove being shaped to receive a groove part of a flexible tongue, said flexible tongue having a locking part which is formed in one piece with the groove part, said locking part extending beyond the second joint edge and a second groove formed in one piece with the panels at the first joint edge (2), said second groove being shaped to receive the locking part of the flexible tongue when the panels are mechanically locked, thereby forming a vertical mechanical connection between the panels.

In a preferred embodiment hereof, the flexible tongue is flexible and resilient such that two panels can be mechanically joined by displacement of said two panels vertically towards each other, while the locking part of the flexible tongue is resiliently displaced horizontally, until said adjacent edges of the two panels are brought into engagement with each other horizontally and the locking part of the flexible tongue is then displaced towards its initial position and against a wall of the second groove.

Especially, the locking part of the flexible tongue protrudes downwardly.

Furthermore, it is possible that the panels are beveled at the adjacent joint edges at the principal plane.

Of course the other edges of the panels also can comprise locking elements, which e.g. can encompass a locking strip with a locking protrusion on one of the other edges of the panel and a locking groove, corresponding to this locking strip with the locking element, on the other of the edges of the panel. These additional locking elements preferably can be present on the both long edges of the floor panel, if the panel has rectangular shape.

The present invention is described in greater detail below and in the figures.

FIG. 1 shows a view onto a sectional plane which is perpendicular to the joint edges 2 and 3 of a flooring system made of two panels as known from the prior art. The joint edges 2 and 3 proceed into the plane of the figure and are perpendicular to the plane of the figure. Two floor panels 1 and 1' are connected at opposite joined edges 2 and 3 which can be the opposite short edges of a rectangular panel. Each panel 1 and 1' has a first joined edge 2 and a second joined edge 3 which is aligned opposite the first joined edge 2. Otherwise, the panels 1 and 1' have the identical shape. FIG. 1 shows parts of the two panels 1 and 1' in the connected state. The panels 1 and 1' have a protruding strip 4 which accommodates a locking element 5*a*. The locking strip 4 with the locking element 5*a* extends beyond the first joined edge 2. The floor panels 1 and 1' comprise a locking groove 5*b* which is aligned on the second joined edge 3, having a shape that the locking element 5*a* of the first joined edge can engage said locking groove 5*b*. The locking element 5*a* has an external edge 6*a* which limits the locking element 5*a* forming the most remote edge of the locking strip 4 and/or locking element 5*a*.

Said external edge 6*a* accommodates a recess 7 which e.g. can be an undercut in the edge 6*a*.

On the other hand side, the locking groove 5*b* has an internal edge 6*b*, which is the most internal edge of the locking groove 5*b*. Said edge 6*b* accommodates a protrusion 8. Recess and protrusion 8 have a shape that they engage with each other in the locked state of the panels 1 and 1'.

The panels 1 and 1' have a principle plane PP (or synonymously an upper side or visible side) and a rear side RS (or synonymously backing side).

The panels 1 and 1' preferably encompass a core 9, a decorative layer 10 as well as a backing layer 11.

The dimension of the panels with respect of the thickness (i.e. the dimension from the rear side RS to the principle plane PP) is d.

Furthermore, a dust pocket 12 can be present in between the first joined edge 2 and the second joined edge 3.

The recess 7 has an upper locking surface 7' whereas the protrusion 8 has an upper locking surface 8' which are shaped that in the installed state of the panels 1, 1' the overlap in a region OL in order to provide a locking in the vertical direction (this is the direction from the rear side RS to the principal plane PP). In recess 7 and protrusion 8 inclusive the respective upper locking surfaces 7' and 8', respectively are so shaped that the installed state a physical contact is guaranteed over the entire area of the locking surfaces 7' and 8'.

This, however, leads to drawbacks as far as the flexibility of the installation is concerned, especially when the panels are warped, as displayed in the following figures.

Figure 2:
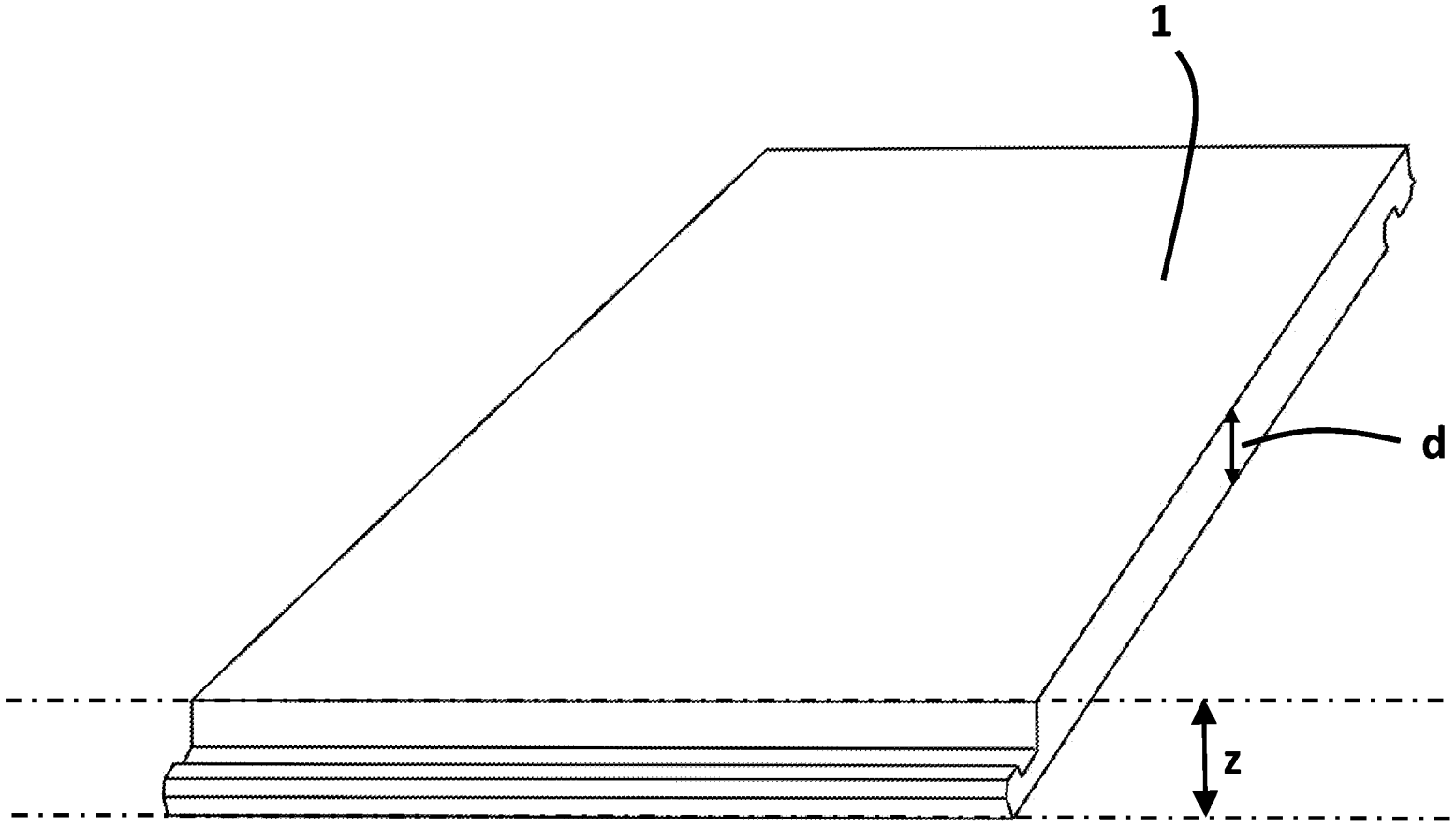
FIG. 2 shows an unwarped flooring panel.

FIG. 2 shows in a schematic manner an unwarped panel 1, having a thickness d. the panel 1 is completely flat or even as can be seen by the dashed lines. Accordingly, the maximum dimension z at the side of the panel where the locking element is present is equal to the thickness d.

Figure 3:
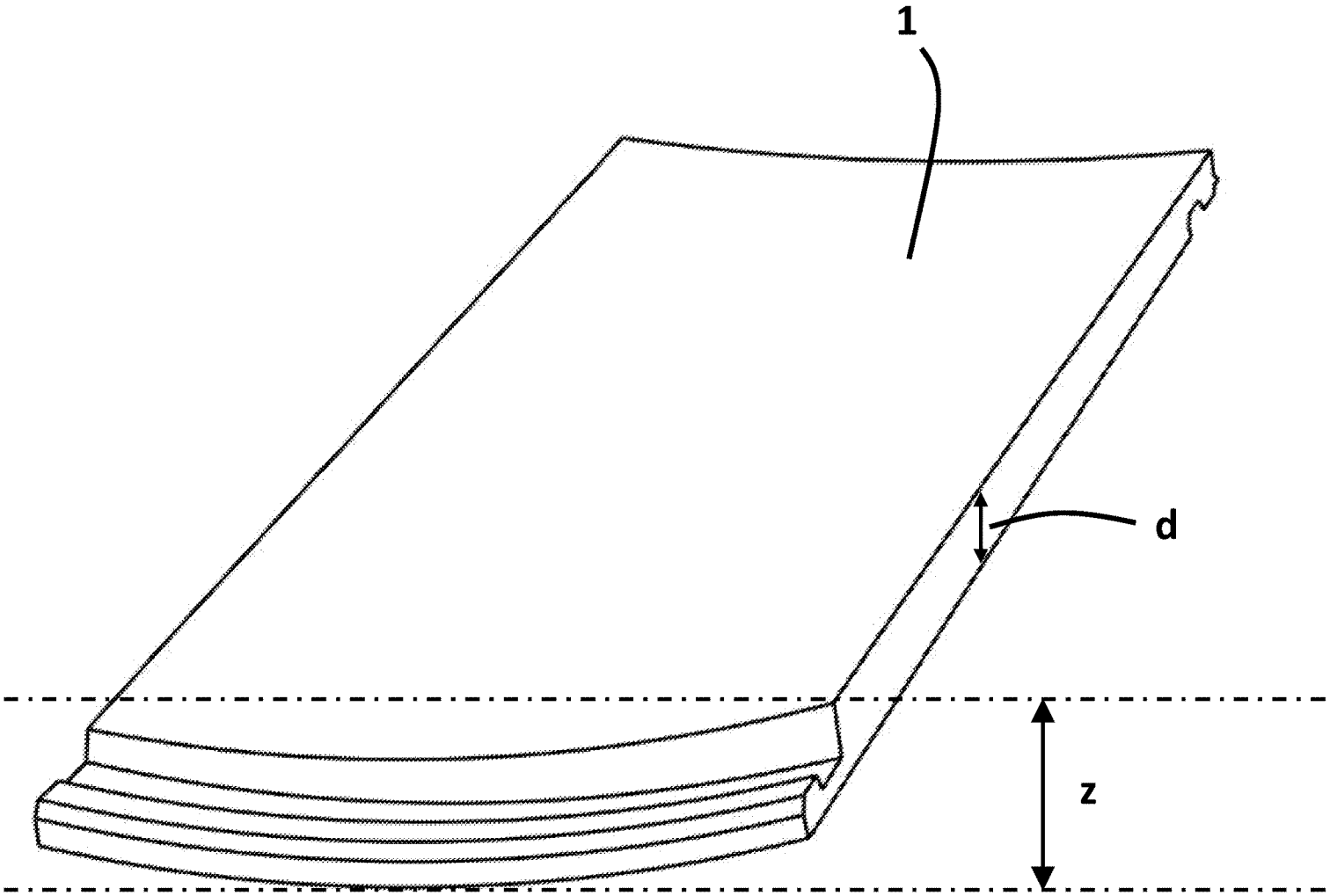
FIG. 3 shows a flooring panel being warped at an edge where a mechanical locking element is present.

FIG. 3 shows a slightly warped panel 1, which otherwise is identical to the panel as displayed in FIG. 2. As can be seen, the panel has a slight curvature at the short side, where the locking element is present (displayed in the foreground). Accordingly, the maximum dimension z of the panel (being the difference of the highest point of the principle plane of the panel and the lowest point of the rear side of the panel) is bigger than the thickness d of the panel which can be measured at the other edge (in this case the long edge). This warpage likely occurs when the panels partly are fully made of natural materials, such as wood etc., and are due to the fact that these materials alter their dimensions with varying of external factors such as temperature, moisture, water content or age. The situation that a panel 1 does not have the ideal flat shape, such as shown in FIG. 2, but are slightly bended or have a warped structure as described in FIG. 3 regularly occurs. Normally a plurality of panels to be installed with each other have different or individual warpage, thus making the panels not ideally fitting with each other at the joint edges.

If the locking elements such as shown in FIG. 1 are fully form-fitting (i.e. that the upper locking surfaces 7' and 8' are designed to be in complete form-fit with each other so that no gap is present between them), the installation of warped panels as displayed in FIG. 3 with panels having a different degree of warpage (i.e. panels in which the ratio z/d is different) becomes disturbed or even impossible. In any case, enhanced mechanical force is needed in order to properly install such differently warped panels. A damaging or even destruction of the locking elements thus is possible, making the panels in the worst case not suitable for a proper installation.

Figure 4:
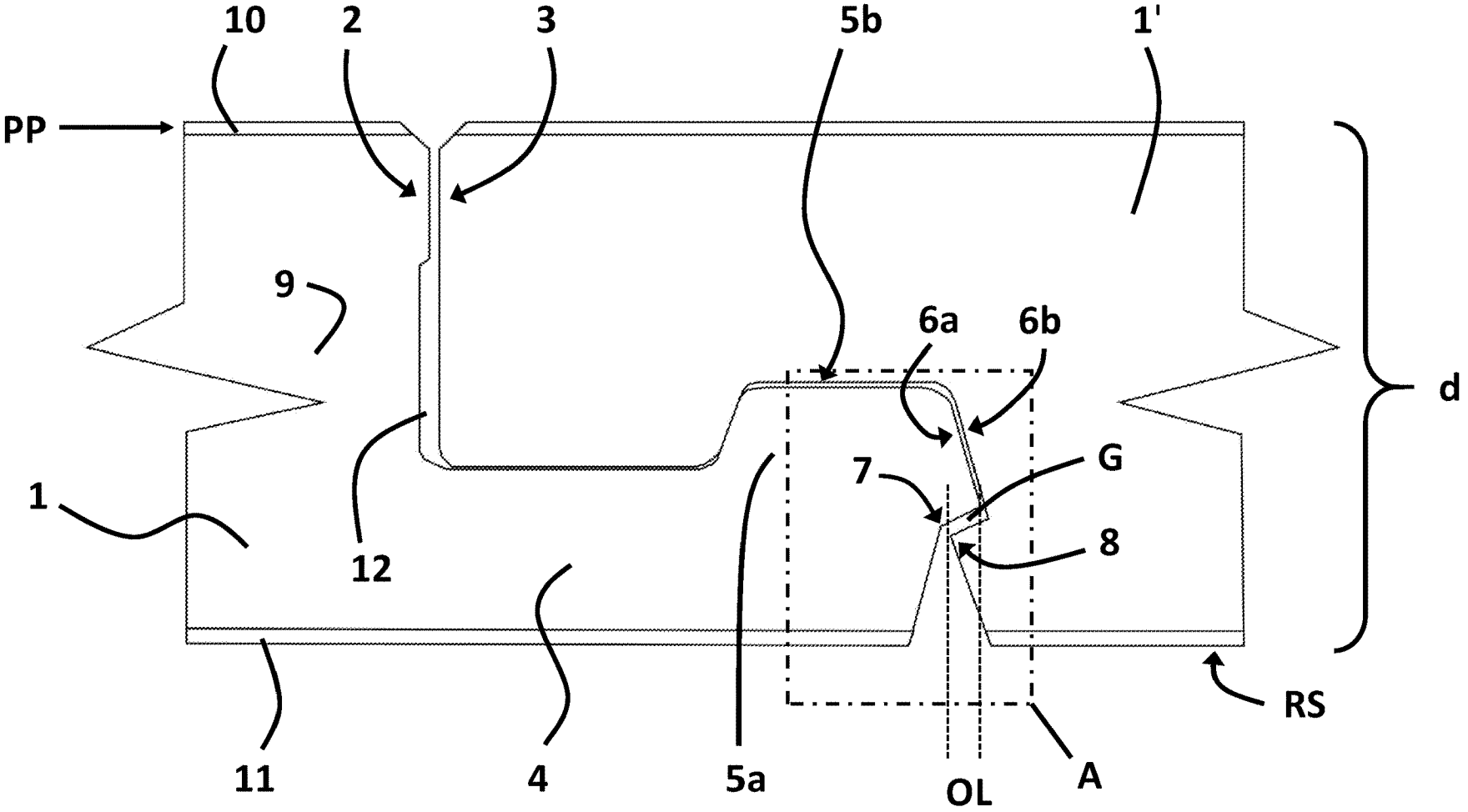
FIG. 4 shows a view on a sectional plane which is perpendicular to the joint edges of a flooring panel of a flooring system according to the present invention.

FIG. 4 displays a view onto a sectional plane which is perpendicular to the joint edges 2 and 3 of a flooring system according to the present invention. Again, the joint edges 2 and 3 proceed into the plane of the figure and are perpendicular to the plane of the figure. The panels 1 and 1' have almost identical shape as FIG. 1. The same numerals depict the same elements. In order to avoid repetitions only the differences of the flooring system according to FIG. 4 with respect to the flooring system according to FIG. 1 will be discussed in the following. All not mentioned elements are the same as in FIG. 1.

The flooring system according to FIG. 4 has also a recess 7 as well as a protrusion 8. However, and in contrast to the flooring system according to FIG. 1, each panel 1, 1' is designed that at any sectional or slice plane perpendicular to the first or second joint edges 2 and 3 at any given position of the overlap OL the upper locking surface 7' of the recess 7 is distanced further from the rear side RS than the upper locking surface 8' of the protrusion 8 to form a gap G.

The specific design of each panel 1, 1' enables that a gap G is or at least can be present in between the recess 7 and the protrusion 8 or the respective locking surfaces 7' and 8' thereof when the panels are mechanically joined, i.e. a (slight) play in the vertical locking element of the panels is given. This play contributes to a better installability of two panels 1 and 1', especially if the panels show different degrees of warpage as displayed in FIG. 3. Less force is needed to install the panels with respect to each other, without being detrimental to the vertical locking function.

Figure 5:
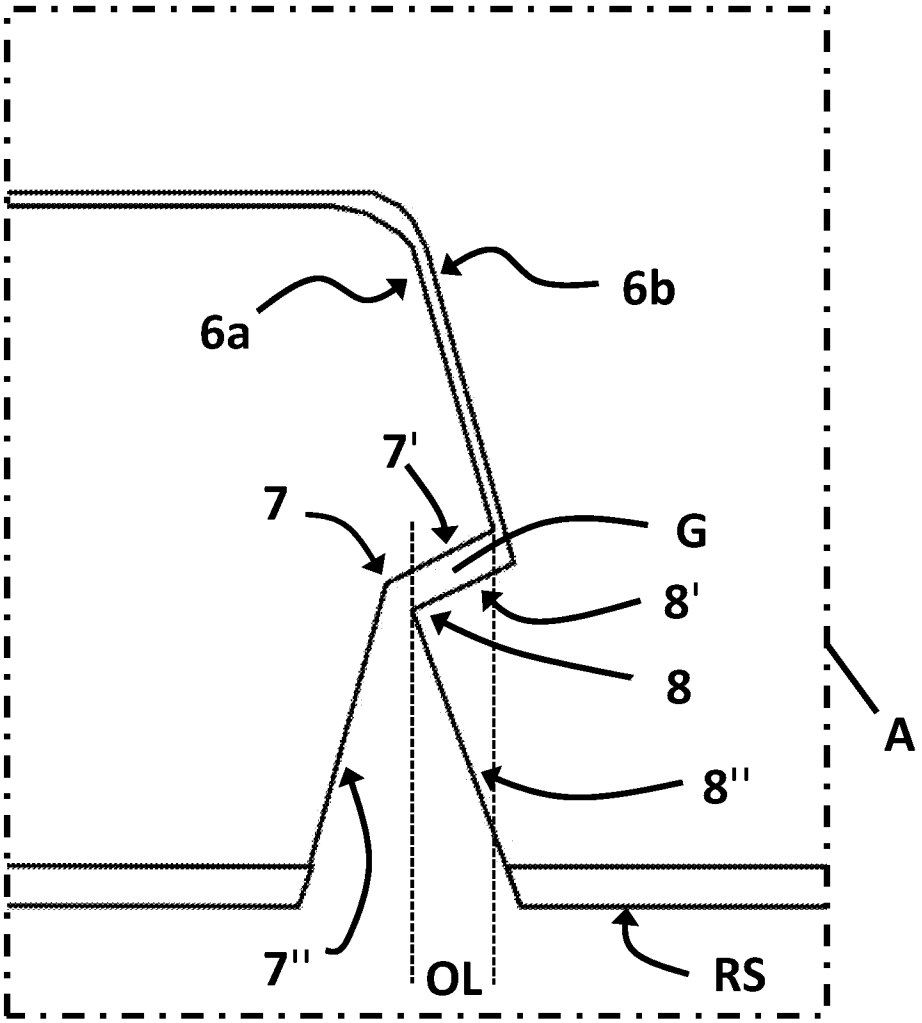
FIG. 5 shows an enlarged detail of FIG. 4.

FIG. 5 describes or displays an enlarged view of the dashed box A in FIG. 4.

The recess 7 is defined by an intersection of the upper locking surface 7' 7' and a second edge or surface 7". The upper locking surface 7' 7' falls of the external edge 6*a*, whereas the second edge 7" intersects with upper locking surface 7' at an obtuse angle.

Likewise, the protrusion 8 is defined by an intersection of the upper locking surface 8' and a second edge or surface 8". Preferably, the upper locking surfaces 7' and 8' are parallel, so that the width of gap G is constant. The gap G allows for a slight play of the two panels 1 and 1' against each other, especially if two panels exhibit different warpage.

To clarify the use of and to hereby provide notice to the public, the phrases "at least one of <A>, <B>, . . . and <N>" or "at least one of <A>, <B>, . . . <N>, or combinations thereof" or "<A>, <B>, . . . and/or <N>" are defined by the Applicant in the broadest sense, superseding any other implied definitions hereinbefore or hereinafter unless expressly asserted by the Applicant to the contrary, to mean one or more elements selected from the group comprising A, B, . . . and N. In other words, the phrases mean any combination of one or more of the elements A, B, . . . or N including any one element alone or the one element in combination with one or more of the other elements which may also include, in combination, additional elements not listed. Unless otherwise indicated or the context suggests otherwise, as used herein, "a" or "an" means "at least one" or "one or more."

The invention claimed is:

1. A flooring system comprising: a plurality of floor panels, said plurality of floor panels mechanically connectable to each other along at least one pair of adjacent first and second opposite joint edges, said panels being provided with a locking strip provided at said first joint edge, said locking strip extending beyond the first joint edge and being provided with a locking element extending in direction of the principal plane (PP) of the panels, a locking groove at said second opposite joint edge configured to receive said locking element and thus mechanically locking together said adjacent joint edges parallel to a principal plane (PP), the locking groove being open towards a rear side (RS) of the panel, wherein a) said locking element comprises an external edge with a recess with an upper locking surface, and said locking groove comprises an internal edge with a protrusion with an upper locking surface, or b) said locking element comprises an external edge with a protrusion with an upper locking surface, and said locking groove comprises an internal edge with a recess with an upper locking surface, wherein said protrusion is configured to engage said recess when two panels are mechanically connected to each other, so that in projection on the principal plane (PP) the upper locking surface of the recess and the upper locking surface of the protrusion overlap (OL), wherein at any given position of the overlap (OL) in any sectional plane of each panel, said plane being perpendicular to the adjacent first and second opposite joint edges the upper locking surface of the recess is distanced further from the rear side (RS) than the upper locking surface of the protrusion to form a gap (G), wherein the upper locking surface of the recess and the upper locking surface of the protrusion, at any given position of the overlap (OL), have a minimum distance from each other of 0.05 to 2.0 mm.

2. The flooring system of claim 1, wherein a) said recess is defined by the upper locking surface falling off from the external edge in direction of the first joint edge and a second edge intersecting with the upper locking surface, wherein the upper locking surface and the second edge form a obtuse angle at said recess, and/or said protrusion is defined by the upper locking surface protruding from the internal edge in direction of the first joint edge and a second edge falling off from the upper locking surface, wherein the upper locking surface and the second edge form an angle at said protrusion, said angle being smaller than the obtuse angle defining said recess, or, respectively, b) said recess is defined by the upper locking surface falling off from the internal edge in direction of the second joint edge and a second edge intersecting with the upper locking surface, wherein the upper locking surface and the second edge form a obtuse angle at said recess, and/or said protrusion is defined by the upper locking surface protruding from the external edge in direction of the second joint edge and a second edge falling off from the upper locking surface, wherein the upper locking surface and the second edge form an angle at said protrusion, said angle being smaller than the obtuse angle defining said recess.

3. The flooring system of claim 1, wherein the upper locking surface of the recess, the upper locking surface of the protrusion, the second edge of the recess and/or the second edge of the protrusion are straight, wavy, curved, or straight.

4. The flooring system of claim 1, wherein in each panel a distance of the upper locking surface of the recess and the upper locking surface of the protrusion at any given position of the overlap (OL) is constant.

5. The flooring system of claim 1, wherein the upper locking surface of the recess and the upper locking surface of the protrusion both are straight and have an angle of 10° to 50° with respect to the principal plane (PP).

6. The flooring system of claim 1, wherein the obtuse angle is in between 100° and 170°.

7. The flooring system of claim 1, wherein the upper locking surface of the protrusion and the second edge of the protrusion form an angle between 80° to 130°.

8. The flooring system of claim 1, wherein said panels are made of a core, a decorative layer or a decorative layer and a backing layer, wherein the locking strip and the locking groove are made in the core.

9. The flooring system of claim 8, wherein the core comprises wood, a wood-based material, chipboard, thermoplastic resin, mineral-wool, glass-wool, rock-wool, and/or cement, wherein the decorative layer is made of a decorative paper with an optional abrasion-resistant topping, and/or is printed to the core; and/or the backing layer is made of paper, veneer, cork, rubber and/or thermoplastic resin, or a foamed material.

10. The flooring system according to claim 9, wherein the wood based material is MDF, HDF, OSB or chipboard.

11. The flooring system according to claim 9, wherein the thermoplastic resin is PVC.

12. The flooring system of claim 1, wherein the locking strip with the locking element is formed in one piece with the panels or provided as a separate part fixed to the panels at the first joint edges.

13. The flooring system of claim 1, wherein the first and/or second joint edges comprise at least one dust pocket.

14. The flooring system of claim 1, wherein the panels are provided with a first groove formed in one piece with the panels at the first joint edge, said first groove being shaped to receive a groove part of a flexible tongue, said flexible tongue having a locking part formed in one piece with the groove part, said locking part extending beyond the first joint edge and a second groove formed in one piece with the panels at the second joint edge, said second groove being shaped to receive the locking part of the flexible tongue when the panels are mechanically locked, thereby forming a vertical mechanical connection between the panels, or a first groove formed in one piece with the panels at the second joint edge, said first groove being shaped to receive a groove part of a flexible tongue, said flexible tongue having a locking part being formed in one piece with the groove part, said locking part extending beyond the second joint edge and a second groove formed in one piece with the panels at the first joint edge, said second groove being shaped to receive the locking part of the flexible tongue when the panels are mechanically locked, thereby forming a vertical mechanical connection between the panels.

15. The flooring system of claim 14, wherein the flexible tongue is flexible and resilient such that two panels can be mechanically joined by displacement of said two panels vertically towards each other, while the locking part of the flexible tongue is resiliently displaced horizontally, until said adjacent edges of the two panels are brought into engagement with each other horizontally and the locking part of the flexible tongue is then displaced towards its initial position and against a wall of the second groove.

16. The flooring system of claim 14, wherein the locking part of the flexible tongue protrudes downwardly.

17. The flooring system of claim 1, wherein the panels are bevelled at the adjacent joint edges at the principal plane (PP).

* * * * *